US010456888B2

(12) United States Patent
Mukai et al.

(10) Patent No.: US 10,456,888 B2
(45) Date of Patent: Oct. 29, 2019

(54) ABRASIVE MATERIAL AND PRODUCTION METHOD OF ABRASIVE MATERIAL

(71) Applicant: BANDO CHEMICAL INDUSTRIES, LTD., Hyogo (JP)

(72) Inventors: Fumihiro Mukai, Kobe (JP); Tomoki Iwanaga, Kobe (JP); Daisuke Takagi, Kobe (JP); Kazuo Saito, Kobe (JP); Toshikazu Taura, Kobe (JP)

(73) Assignee: BANDO CHEMICAL INDUSTRIES, LTD., Hyogo (JP)

( * ) Notice: Subject to any disclaimer, the term of this patent is extended or adjusted under 35 U.S.C. 154(b) by 0 days.

(21) Appl. No.: 15/522,780

(22) PCT Filed: Oct. 6, 2015

(86) PCT No.: PCT/JP2015/078401

§ 371 (c)(1),
(2) Date: Apr. 28, 2017

(87) PCT Pub. No.: WO2016/067857

PCT Pub. Date: May 6, 2016

(65) Prior Publication Data

US 2017/0312886 A1 Nov. 2, 2017

(30) Foreign Application Priority Data

Oct. 28, 2014 (JP) ..... 2014-219748

(51) Int. Cl.

| | |
|---|---|
| ***B24D 3/04*** | (2006.01) |
| ***B24D 3/34*** | (2006.01) |
| ***B24B 37/24*** | (2012.01) |

(52) U.S. Cl.

CPC ..... *B24D 3/04* (2013.01); *B24B 37/24* (2013.01)

(58) Field of Classification Search

CPC ..... B24D 3/04; B24D 3/34; B24B 37/24

See application file for complete search history.

(56) References Cited

U.S. PATENT DOCUMENTS 5,851,247 A * 12/1998 Stoetzel ..... B24D 3/002 51/295
5,975,988 A * 11/1999 Christianson ..... B24D 3/002 451/28

(Continued)

FOREIGN PATENT DOCUMENTS

| | | |
|---|---|---|
| EP | 0052758 | 6/1982 |
| JP | 57-114367 | 7/1982 |

(Continued)

OTHER PUBLICATIONS

"International Search Report (Form PCT/ISA/210)", dated Dec. 15, 2015, with English translation thereof, pp. 1-4.

*Primary Examiner* — Pegah Parvini
(74) *Attorney, Agent, or Firm* — JCIPRNET

(57) ABSTRACT

It is an object of the present invention to provide an abrasive material which enables: processing efficiency and finished planarity of a substrate material to be simultaneously improved at a high level; polishing costs to be reduced; and a difficult-to-process substrate composed of sapphire or silicon carbide to be polished efficiently and precisely. An abrasive material comprises a substrate and an abrasive layer laminated on a front face side of the substrate, wherein the abrasive layer includes a binder containing an inorganic substance as a principal component, and abrasive particles dispersed in the binder, wherein a front face of the abrasive layer comprises a plurality of regions provided through dividing by grooves, and wherein a maximum peak height (Rp) on the front face of the abrasive layer is no less than 2.5 μm and no greater than 70 μm.

8 Claims, 3 Drawing Sheets

(56) References Cited

U.S. PATENT DOCUMENTS

| | | | | |
|---|---|---|---|---|
| 6,672,952 | B1 * | 1/2004 | Masmar | B24D 3/002 451/539 |
| 2006/0042172 | A1 * | 3/2006 | Sung | C09K 3/1409 51/309 |
| 2006/0135050 | A1 * | 6/2006 | Petersen | B24D 11/005 451/523 |
| 2010/0255254 | A1 * | 10/2010 | Culler | B24D 11/00 428/143 |
| 2011/0053460 | A1 * | 3/2011 | Culler | B24D 11/00 451/28 |

FOREIGN PATENT DOCUMENTS

| | | |
|---|---|---|
| JP | 05-111878 | 5/1993 |
| JP | 2001512375 | 8/2001 |
| JP | 2002-086350 | 3/2002 |
| JP | 2002-542057 | 12/2002 |
| JP | 2004536770 | 12/2004 |
| JP | 2009-511281 | 3/2009 |
| JP | 2009-072832 | 4/2009 |
| JP | 2010-179402 | 8/2010 |
| JP | 2014-100766 | 6/2014 |
| WO | 2000/64633 | 11/2000 |
| WO | 03011785 | 2/2003 |
| WO | 2007/041538 | 4/2007 |

* cited by examiner

ABRASIVE MATERIAL AND PRODUCTION METHOD OF ABRASIVE MATERIAL

CROSS-REFERENCE TO RELATED APPLICATION

This application is a 371 application of the international PCT application serial no. PCT/JP2015/078401, filed on Oct. 6, 2015, which claims the priority benefit of Japan application no. 2014-219748, filed on Oct. 28, 2014. The entirety of each of the abovementioned patent applications is hereby incorporated by reference herein and made a part of this specification.

BACKGROUND OF THE INVENTION

Field of Invention

The present invention relates to an abrasive material and a production method of the abrasive material.

Recently, the refinement of electronic devices such as hard disks has progressed. As a substrate material for such electronic devices, glass or the like is used, taking into consideration of rigidity, shock resistance and heat resistance that serve in enabling miniaturization and thinning.

Processing of such a substrate (a material to be cut) is carried out principally by lapping and polishing. First, mechanical abrasive polishing is carried out by using hard particles such as diamond in the lapping so as to control the thickness of the substrate and planarize the substrate. Then, chemical abrasive polishing is carried out by using fine particles such as ceria in the polishing so as to improve accuracy of planarization (hereinafter, may be referred to as "planarizing accuracy") of the surface of the substrate.

Typically, when the improvement of the planarizing accuracy after finishing is sought, a processing time period tends to become longer. In other words, efficiency of processing (hereinafter, may be referred to as "processing efficiency") and the planarizing accuracy are in a trade-off relation. Therefore, it is difficult to achieve an improvement of both the processing efficiency and the planarizing accuracy. In this regard, in order to simultaneously improve the processing efficiency and planarizing accuracy after lapping, an abrasive pad is proposed which comprises an abrasive layer comprising a binder and abrasive grains, wherein the abrasive layer has protruding portions (see Japanese Unexamined Patent Application (Translation of PCT Publication), Publication No. 2002-542057).

However, such an abrasive pad of prior art cannot simultaneously improve the processing efficiency and planarizing accuracy, and thus a further simultaneous improvement of the processing efficiency and finished planarity at a higher level has been demanded.

Furthermore, recently, a substrate being difficult to process and having hard brittle and chemically stable properties such as sapphire and silicon carbide for use in an LED or a power device has been increasingly demanded. For such a difficult-to-process substrate, a polishing method of a silicon substrate with a higher efficiency than polishing methods which have already been established has been required. Moreover, since such a substrate is chemically stable, a substantial period of time is needed for CMP (Chemical Mechanical Polishing) which is carried out in the final step of polishing. Therefore, it is necessary to shorten the time period for the CMP by reducing surface roughness and surface damage of a substrate to a level as low as possible in the polishing which is a step prior to the CMP. Consequently, higher accuracy of polishing (hereinafter, may be referred to as "polishing accuracy") in the polishing prior to the CMP is required.

As a polishing method of such a difficult-to-process substrate, loose abrasive polishing using an abrasive particle slurry and an abrasive pad (see Japanese Unexamined Patent Application, Publication No. 2014-100766) and semi-fixed abrasive polishing which performs polishing by retaining loose abrasive particles in pores on the surface of the abrasive pad (see Japanese Unexamined Patent Application, Publication No. 2002-86350) have been proposed.

The loose abrasive polishing and the semi-fixed abrasive polishing of prior art achieve polishing with high efficiency by using diamond for abrasive particles. However, the loose abrasive polishing and the semi-fixed abrasive polishing of prior art require a continuous supply of the abrasive particles to the abrasive pad, and thus incur high polishing costs.

PRIOR ART DOCUMENTS

Patent Documents

Patent Document 1: Japanese Unexamined Patent Application (Translation of PCT Publication), Publication No. 2002-542057

Patent Document 2: Japanese Unexamined Patent Application, Publication No. 2014-100766

Patent Document 3: Japanese Unexamined Patent Application, Publication No. 2002-86350

SUMMARY OF THE INVENTION

The present invention has been made to address the foregoing disadvantages, and it is an object of the present invention to provide an abrasive material which enables: processing efficiency and finished planarity of a substrate material to be simultaneously improved at a high level; polishing costs to be decreased; and a difficult-to-process substrate composed of sapphire, silicon carbide or the like to be polished efficiently and precisely.

According to an aspect of the present invention that has been made to solve the problems, an abrasive material comprises a substrate and an abrasive layer laminated on a front face side of the substrate, wherein the abrasive layer comprises a binder comprising an inorganic substance as a principal component, and abrasive particles dispersed in the binder, wherein a front face of the abrasive layer comprises a plurality of regions provided through dividing by grooves, and wherein a maximum peak height (Rp) on the front face of the abrasive layer is no less than 2.5 μm and no greater than 70 μm.

According to the abrasive material of the present invention, since the abrasive layer comprises the binder comprising an inorganic substance as a principal component, the retaining force of the abrasive particles becomes so high that the abrasive particles are less likely to be separated. Furthermore, since the maximum peak height (Rp) on the front face of the abrasive layer falls within the aforementioned range, the projecting amount of a part of the abrasive particles from the surface of the binder can be made large while the abrasive material enables the retaining force of the abrasive particles to be maintained. Thus, the abrasive particles have a superior polishing force from the beginning of use. Therefore, according to the abrasive material of the present invention, since the abrasive particles are less likely to be separated and the abrasive particles have a superior polishing force, attaining a high polishing efficiency is enabled. Furthermore, according to the abrasive material of the present invention, since the front face of the abrasive layer comprises a plurality of regions provided through dividing by grooves, a surface pressure to a substrate to be processed and the number of working points to be polished can be easily controlled, leading to a high polishing accuracy. Moreover, according to the abrasive material of the present invention, since it is unnecessary to supply additional abrasive particles during polishing, costs for polishing using the abrasive material of the present invention can be decreased.

The plurality of regions are preferably provided such that at least two thereof are disposed along each of mutually orthogonal X and Y directions in a planar view. By virtue of thus providing the plurality of regions such that at least two thereof are disposed along each of mutually orthogonal X and Y directions in a planar view, anisotropy of a surface pressure and the like toward a substrate to be processed can be reduced whereby the polishing accuracy can be further improved.

The binder preferably contains an oxide filler comprising an oxide as a principal component, and an average particle diameter of the oxide filler is preferably smaller than an average particle diameter of the abrasive particles. By virtue of the aforementioned binder containing an oxide filler comprising an oxide as a principal component, elasticity of the binder can be improved and wear of the abrasive layer can be inhibited. Furthermore, by virtue of the abrasive particles and the oxide filler projecting from the binder, the maximum peak height (Rp) on the front face of the abrasive layer can be easily controlled so as to fall within a predetermined range, and the abrasive layer having a superior polishing force can be reliably obtained from the beginning of use. Moreover, by making the average particle diameter of the oxide filler smaller than the average particle diameter of the abrasive particles, the grinding force of the abrasive particles is not inhibited and thus a high polishing force of the abrasive layer can be maintained.

The inorganic substance is preferably a silicate salt. In a case where the inorganic substance is a silicate salt, an abrasive particle-retaining force of the abrasive layer can be further improved.

The abrasive particles is preferably diamond. In a case where the abrasive particles are diamond, the polishing force can be further improved.

The abrasive layer is preferably formed by a printing process. By virtue of thus forming the abrasive layer by a printing process, a part of the abrasive particles can be easily projected from the surface of the binder, whereby the maximum peak height (Rp) on the front face of the abrasive layer can be easily controlled so as to fall within a predetermined range. Therefore, attaining high polishing efficiency is enabled from the beginning of use.

According to another aspect of the present invention that has been made to solve the problems, a production method of an abrasive material comprising a substrate and an abrasive layer laminated on a front face side of the substrate comprises the step of forming the abrasive layer by printing with an abrasive layer composition, wherein the abrasive layer composition comprises a binder component comprising an inorganic substance as a principal component, and abrasive particles.

Since the production method of the abrasive material forms the abrasive layer by printing with an abrasive layer composition, easy and secure formation of the grooves that divide the front face of the abrasive layer, and the front face of the abrasive layer with the maximum peak height (Rp) on the front face controlled to fall within a predetermine range by means of projections of a part of the abrasive particles from the surface of the binder 21 is enabled. Therefore, the abrasive material produced according to the production method of an abrasive material of the present invention involves a high polishing efficiency and a high polishing accuracy.

The term "principal component" as referred herein to means a component having the highest content, and, for example, refers to a content of no less than 50% by mass. The term "maximum peak height (Rp)" as referred to herein means a value measured with the settings of: cut-off of 0.25 mm; and measuring length of 1.25 mm, as determined according to the procedure defined in JIS-B-0601:2001. Furthermore, the term "average particle diameter" as referred to herein means the value at 50% in a cumulative particle size distribution curve based on the volume as measured by a laser diffraction method or the like (the particle diameter at 50%, D50).

As explained in the foregoing, the abrasive material according to the aspect of the present invention enables processing efficiency and finished planarity of a substrate material to be simultaneously improves and polishing costs to be decreased. Therefore, the abrasive material according to the aspect of the present invention can be preferably used for polishing a glass substrate used for use in electronic devices, etc., and a difficult-to-process substrate composed of sapphire, silicon carbide or the like.

DESCRIPTION OF EMBODIMENTS

Hereinafter, embodiments of the present invention will be described with reference to the drawings.

Abrasive Material

Figure 1A:
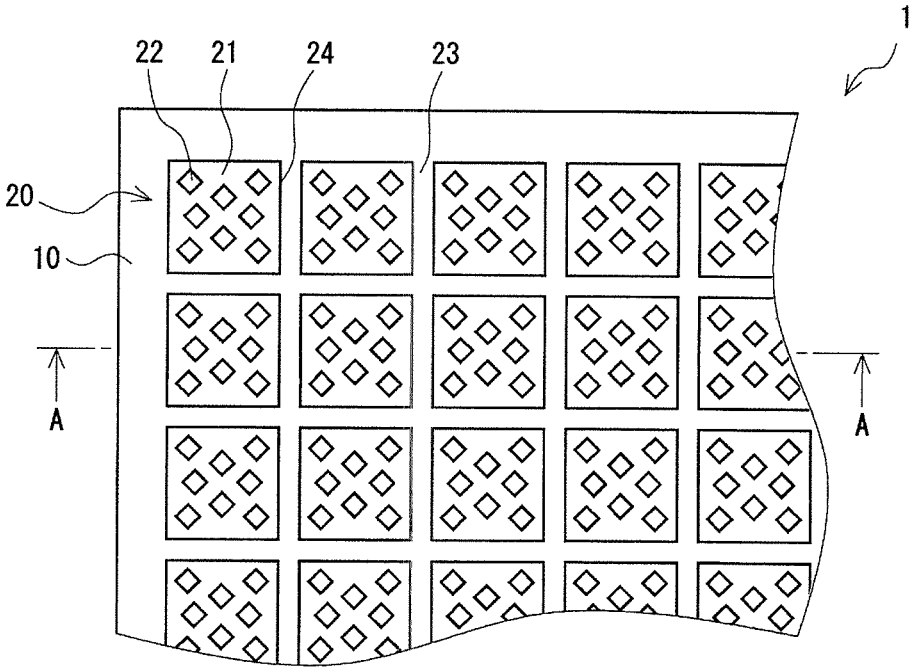
FIG. 1A is a schematic plan view illustrating an abrasive material according to an embodiment of the present invention.
Figure 1B:
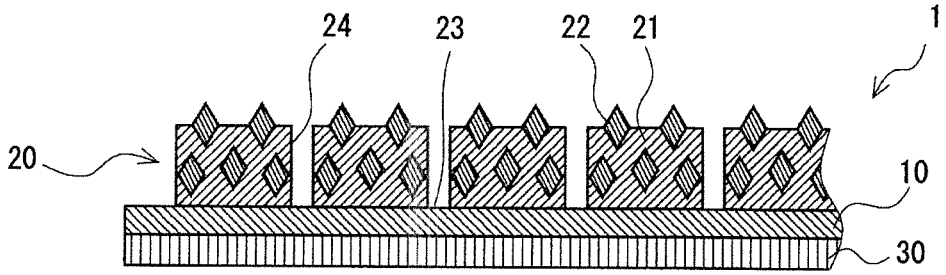
FIG. 1B is a sectional view along the line A-A of FIG. 1A.

An abrasive material 1 illustrated in FIGS. 1A and 1B includes a substrate 10, an abrasive layer 20 laminated on the front face side of the substrate 10, and an adhesion layer 30 laminated on the back face side of the substrate 10.

Substrate

The substrate 10 is a plate-like member for supporting the abrasive layer 20.

A material of the substrate 10 is not particularly limited and examples of the material include polyethylene terephthalate (PET), polypropylene (PP), polyethylene (PE), polyimide (PI), polyethylene naphthalate (PEN), aramid, aluminum, copper, and the like. Among these, aluminum having superior adhesive properties with the abrasive layer 20 is preferred. Furthermore, a front face of the substrate 10 may be subjected to a treatment such as a chemical treatment, a corona treatment, and a primer treatment for enhancing the adhesive properties.

The substrate 10 may have flexibility or ductility. When the substrate 10 thus has flexibility or ductility, the abrasive material 1 follows the surface profile of a material to be cut so that a polishing face thereof and the material to be cut can be easily in contact with each other, whereby the polishing efficiency can be further improved. Examples of such a substrate 10 having flexibility include PET and PI. Furthermore, examples of such a substrate 10 having ductility include aluminum and copper.

The shape and size of the substrate 10 is not particularly limited, and may be, for example, in a square shape with a side of no less than 140 mm and no greater than 160 mm, or in a circular shape with an outer diameter of no less than 600 mm and no greater than 650 mm and an inner diameter of no less than 200 mm and no greater than 250 mm. Alternatively, a plurality of the substrates 10 arranged in parallel on a plane may be supported by a single support.

The average thickness of the substrate 10 is not particularly limited and may be, for example, no less than 75 μm and no greater than 1 mm. When the average thickness of the substrate 10 is less than the lower limit, the strength or the planarity of the abrasive material 1 may be insufficient. On the other hand, when the average thickness of the substrate 10 is greater than the upper limit, the abrasive material 1 may be unnecessarily thick and the handling thereof may be difficult.

Abrasive Layer

The abrasive layer 20 includes a binder 21 containing an inorganic substance as a principal component, and abrasive particles 22 dispersed in the binder 21. Furthermore, the abrasive layer 20 includes a plurality of regions (protruding portions 24) which are formed by having the surface of the abrasive layer 20 divided by grooves 23.

The average thickness of the abrasive layer 20 (the average thickness of only the protruding portions 24) is not particularly limited. The lower limit of the average thickness of the abrasive layer 20 is preferably 100 μm, and more preferably 130 μm. The upper limit of the average thickness of the abrasive layer 20 is preferably 1,000 μm, and more preferably 800 μm. When the average thickness of the abrasive layer 20 is less than the lower limit, durability of the abrasive layer 20 may be insufficient. On the other hand, when the average thickness of the abrasive layer 20 is greater than the upper limit, the abrasive material 1 may be unnecessarily thick, and thus, the handling thereof may be difficult.

Binder

Examples of the inorganic substance as a principal component of the binder 21 include a silicate salt, a phosphate salt, a polyvalent metal alkoxide, and the like. Among these, a silicate salt having a superior abrasive particle-retaining force of the abrasive layer 20 is preferred.

Furthermore, the binder 21 may contain an oxide filler including an oxide as a principal component. When the binder 21 contains an oxide filler, elasticity of the binder 21 can be improved, and thus, wear of the abrasive layer 20 can be inhibited.

Examples of the oxide filler include: oxides such as alumina, silica, cerium oxide, magnesium, oxide, zirconia and titanium oxide; and complex oxides such as silica-alumina, silica-zirconia and silica-magnesia. These may be used either alone or in combination of two or more thereof. Among these, alumina capable of providing a superior abrasive force is preferred.

Although the average particle diameter of the oxide filler may depend on the average particle diameter of the abrasive particles 22, the average particle diameter thereof may be no less than 0.01 μm and no greater than 20 μm, for example. When the average particle diameter of the oxide filler is less than the lower limit, the improving effect of elasticity of the binder 21 due to the oxide filler may not be obtained sufficiently. On the other hand, when the average particle diameter of the oxide filler is greater than the upper limit, the oxide filler may inhibit the polishing force of the abrasive particles 22.

Furthermore, the average particle diameter of the oxide filler may be smaller than the average particle diameter of the abrasive particles 22. The lower limit of the ratio of the average particle diameter of the oxide filler to the average particle diameter of the abrasive particles 22 is preferably 0.1, and more preferably 0.2. Furthermore, the upper limit of the ratio of the average particle diameter of the oxide filler to the average particle diameter of the abrasive particles 22 is preferably 0.8, and more preferably 0.6. When the ratio of the average particle diameter of the oxide filler to the average particle diameter of the abrasive particles 22 is less than the lower limit, the improving effect of elasticity of the binder 21 due to the oxide filler may lack relatively, and thus wear of the abrasive layer 20 may not be inhibited sufficiently. On the other hand, when the ratio of the average particle diameter of the oxide filler to the average particle diameter of the abrasive particles 22 is greater than the upper limit, the oxide filler may inhibit the polishing force of the abrasive particles 22.

Although the content of the oxide filler with respect to the abrasive layer 20 may depend on the content of the abrasive particles 22, the lower limit of the content of the oxide filler with respect to the abrasive layer 20 is preferably 15 volume %, and more preferably 30 volume %. Furthermore, the upper limit of the content of the oxide filler with respect to the abrasive layer 20 is preferably 75 volume %, and more preferably 60 volume %. When the content of the oxide filler with respect to the abrasive layer 20 is less than the lower limit, the improving effect of elasticity of the binder 21 due to the oxide filler may not be obtained sufficiently. On the other hand, when the content of the oxide filler with respect to the abrasive layer 20 is greater than the upper limit, the oxide filler may inhibit the polishing force of the abrasive particles 22.

Furthermore, the binder 21 may contain a dispersant, a coupling agent, a surfactant, a lubricant, a defoaming agent, a colorant, various types of an auxiliary agent, an additive, and the like, appropriately according to a purpose.

Abrasive Particle

Examples of the abrasive particles 22 include particles of diamond, alumina, silica, ceria, silicon carbide, and the like. Among these, diamond particles capable of providing a superior grinding force is preferred. The diamond particles may be either monocrystalline or polycrystalline, or may be diamond having been subjected to a treatment such as Ni coating.

The average particle diameter of the abrasive particles 22 is appropriately selected in view of a polishing speed and a surface roughness of a material to be cut after being polished. The lower limit of the average particle diameter of the abrasive particles 22 is preferably 2 μm, more preferably 10 μm, and still more preferably 15 μm. On the other hand, the upper limit of the average particle diameter of the abrasive particles 22 is preferably 45 μm, more preferably 30 μm, and still more preferably 25 μm. When the average particle diameter of the abrasive particles 22 is less than the lower limit, the polishing force of the abrasive material 1 may be insufficient and thus the polishing efficiency may decrease. On the other hand, when the average particle diameter of the abrasive particles 22 is greater than the upper limit, the polishing accuracy may decrease.

The lower limit of the content of the abrasive particles 22 with respect to the abrasive layer 20 is preferably 3 volume %, more preferably 4 volume %, and still more preferably 8 volume %. On the other hand, the upper limit of the content of the abrasive particles 22 with respect to the abrasive layer 20 is preferably 55 volume %, more preferably 35 volume %, and still more preferably 20 volume %. When the content of the abrasive particles 22 with respect to the abrasive layer 20 is less than the lower limit, the polishing force of the abrasive layer 20 may be insufficient. On the other hand, when the content of the abrasive particles 22 with respect to the abrasive layer 20 is greater than the upper limit, the abrasive layer 20 may not be able to retain the abrasive particles 22.

Furthermore, the abrasive material 1 includes, on a front face of the abrasive layer 20 (a surface of the protruding portion 24), fine unevenness which is considered to be formed principally due to apart of the abrasive particles 22 contained in the protruding portion 24 projecting from the surface of the binder 21. The lower limit of the maximum peak height (Rp) on the front face of the abrasive layer 20 is 2.5 μm, preferably 5 μm, and more preferably 7 μm. On the other hand, the upper limit of the maximum peak height (Rp) on the front face of the abrasive layer 20 is 70 μm, and thus, the maximum peak height 1.5 times the average particle diameter of the abrasive particles 22 is preferred. When the maximum peak height (Rp) on the front face of the abrasive layer 20 is less than the lower limit, the grinding force may be insufficient irrespective of the average particle diameter of the abrasive particles 22 used. On the other hand, when the maximum peak height (Rp) on the front face of the abrasive layer 20 is greater than the upper limit, the abrasive layer 20 fails to physically retain the abrasive particles 22 and thus the abrasive particles 22 may be separated. It should be noted that the maximum peak height (Rp) on the front face of the abrasive layer 20 can be controlled, for example, by adjusting the concentration of a coating liquid when forming the abrasive layer 20 by a printing process.

The abrasive layer 20 may be formed by a printing process. When the abrasive layer 20 is formed by the printing process, since a part of the abrasive particles 22 can be projected from the surface of the binder 21 easily, the maximum peak height (Rp) on the front face of the abrasive layer 20 can be easily controlled so as to fall within a predetermined range. Therefore, attaining the high polishing efficiency is enabled from the beginning of use.

Protruding Portion

The abrasive layer 20 includes a plurality of protruding portions 24 which are a plurality of regions formed by having the surface of the abrasive layer 20 divided by grooves 23. The grooves 23 are provided on the surface of the abrasive layer 20 in an equally spaced grid manner. In other words, the arrangement of the plurality of protruding portions 24 is in a block pattern in which at least two protruding portions are disposed along each of mutually orthogonal X and Y directions in a planar view. Furthermore, the bottom face of the grooves 23 that divide the protruding portions 24 corresponds to the surface of the substrate 10.

The lower limit of the average width of the grooves 23 is preferably 0.3 mm, and more preferably 0.5 mm. On the other hand, the upper limit of the average width of the grooves 23 is preferably 10 mm, and more preferably 8 mm. When the average width of the grooves 23 is less than the lower limit, an abrasive powder generated by polishing may be clogged in the groove 23. On the other hand, when the average width of the grooves 23 is greater than the upper limit, a scratch may be made on a material to be cut during polishing.

The lower limit of the average area of the protruding portions 24 is preferably 1 $mm^2$, and more preferably 2 $mm^2$. On the other hand, the upper limit of the average area of the protruding portions 24 is preferably 150 $mm^2$, and more preferably 130 $mm^2$. When the average area of the protruding portions 24 is less than the lower limit, the protruding portion 24 may be detached from the substrate 10. On the other hand, when the average area of the protruding portions 24 is greater than the upper limit, the contact area of the abrasive layer 20 with a material to be cut upon polishing may be so large that the polishing efficiency may decrease.

The lower limit of the area occupancy rate of the plurality of protruding portions 24 with respect to the entire abrasive layer 20 is preferably 20%, and more preferably 30%. On the other hand, the upper limit of the area occupancy rate of the plurality of protruding portions 24 with respect to the entire abrasive layer 20 is preferably 60%, and more preferably 55%. When the area occupancy rate of the plurality of protruding portions 24 with respect to the entire abrasive layer 20 is less than the lower limit, the protruding portions 24 may be detached from the substrate 10. On the other hand, when the area occupancy rate of the plurality of protruding portions 24 with respect to the entire abrasive layer 20 is greater than the upper limit, friction resistance of the abrasive layer 20 during polishing may be so high that a scratch may be made on a material to be cut. It should be noted that according to the concept, an entire area of an abrasive layer includes an area of grooves when the grooves are provided on the abrasive layer.

Adhesion Layer

The adhesion layer 30 is a layer that fixes the abrasive material 1 to a support for supporting the abrasive material 1 and attaching it to an abrasive apparatus.

An adhesive used for this adhesion layer 30 is not particularly limited but examples thereof include a reactive adhesive, an instantaneous adhesive, a hot melt adhesive, a tacky adhesive, and the like.

A tacky adhesive (pressure sensitive adhesive) is preferred as the adhesive used for this adhesion layer 30. When using a tacky adhesive as the adhesive used for the adhesion layer 30, since the abrasive material 1 can be detached from the support and replaced with another, the abrasive material 1 and the support can be readily recycled. Such a tacky adhesive is not particularly limited but examples thereof include an acrylic tacky adhesive, an acryl-rubber tacky adhesive, a natural rubber tacky adhesive, a synthetic rubber tacky adhesive such as a butyl rubber, a silicone tacky adhesive, a polyurethane tacky adhesive, and the like.

The lower limit of the average thickness of the adhesion layer 30 is 0.05 mm, and more preferably 0.1 mm. On the other hand, the upper limit of the average thickness of the adhesion layer 30 is preferably 0.3 mm, and more preferably 0.2 mm. When the average thickness of the adhesion layer 30 is less than the lower limit, the adhesive force may be insufficient, and thus the abrasive material 1 may be detached from the support. On the other hand, when the average thickness of the adhesion layer 30 is greater than the upper limit, a too thick adhesion layer 30 may lead to a decrease of workability, for example, a difficulty may be brought about in cutting the abrasive material 1 into a desired shape.

Production Method of Abrasive Material

The abrasive material 1 can be produced by the steps of: preparing an abrasive layer composition; and forming the abrasive layer 20 by printing with the abrasive layer composition.

First, in the step of preparing an abrasive layer composition, an abrasive layer composition containing a forming material of the binder 21 containing an inorganic substance as a principal component, an oxide filler, and the abrasive particles 22 is prepared as a coating liquid.

Then, a diluent such as water, alcohol or the like is added in order to control the viscosity and/or fluidity of the coating liquid. With such a dilution, a part of the abrasive particles 22 included in the protruding portion 24 can be projected from the surface of the binder 21. By increasing the amount of the diluent in this procedure, an increase in the projecting amount of the abrasive particles 22 will be enabled since the binder 21 becomes thinner when the abrasive layer composition is dried in a subsequent step.

Next, in the step of forming the abrasive layer, the coating liquid prepared in the step of preparing the abrasive layer composition is used to form the abrasive layer 20, which includes a plurality of regions provided through dividing by the grooves 23, by the printing process on the front face of the substrate 10. In order to form the grooves 23, a mask having a shape corresponding to the shape of the grooves 23 is provided to print with the coating liquid through this mask. Examples of the printing process include screen printing, metal mask printing, and the like. Then, the abrasive layer 20 is formed through dehydrating by heating as well as hardening by heating of the printed coating liquid. More specifically, for example, the coating liquid is dried at room temperature (25° C.), dehydrated by heating with heat of no less than 70° C. and no greater than 90° C., and hardened with heat of no less than 140° C. and no greater than 160° C. to form the binder 21. In this step, a part of the abrasive particles 22 projects from the surface of the binder 21.

Advantages

According to the abrasive material 1 of the present invention, since the abrasive layer 20 includes the binder 21 containing an inorganic substance as a principal component, the retaining force of the abrasive particles 22 becomes so high that the abrasive particles 22 are less likely to be separated. Furthermore, since the maximum peak height (Rp) on the front face of the abrasive layer 20 falls within a predetermined range, the projecting amount of the part of the abrasive particles 22 from the surface of the binder 21 can be made large while the abrasive material 1 enables the retaining force of the abrasive particles 22 to be maintained. Thus, the abrasive particles 22 have a superior polishing force from the beginning of use. Therefore, according to the abrasive material 1 of the present invention, since the abrasive particles 22 are less likely to be separated and the abrasive particles 22 has a superior polishing force, attaining high polishing efficiency is enabled. Furthermore, according to the abrasive material 1 of the present invention, since the abrasive layer 20 comprises a plurality of regions provided through dividing by grooves 23, a surface pressure to a substrate to be processed and the number of working points to be polished can be easily controlled, leading to a high polishing accuracy. Moreover, according to the abrasive material 1 of the present invention, since it is unnecessary to supply additional abrasive particles 22 during polishing, costs for polishing using the abrasive material 1 of the present invention can be decreased.

Furthermore, according to the production method of the abrasive material 1 of the present invention, since the abrasive layer 20 is formed by printing with the abrasive layer composition, easy and secure formation of the grooves 23 that divide the front face of the abrasive layer 20 and the front face of the abrasive layer 20 with the maximum peak height (Rp) on the front face controlled to fall within a predetermined range by the projection of the part of the abrasive particles 22 from the surface of the binder 21 is enabled.

Other Embodiments

The present invention is not limited to the aforementioned embodiments, and, in addition to the aforementioned embodiments, can be carried out in various modes with alterations and/or improvements being made. Although the grooves are arranged in an equally spaced grid manner in the aforementioned embodiment, the grid spacing may not be equal. For example, the grid spacing can differ from each other in a vertical direction and a transverse direction. However, since anisotropy may incur if the spacing of the groove differs, the equally spaced manner is preferred.

Furthermore, although the case in which the arrangement of the protruding portions is in a block pattern in such a manner that at least two thereof are disposed along each of mutually orthogonal X and Y directions in a planar view is described in the aforementioned embodiment, the arrangement of the protruding portions may be a one-dimensional arrangement in which the protruding portions are arranged only along the X direction, for example.

Furthermore, the planar shape of the grooves may not be in a grid manner, and may be a shape in which polygons other than quadrangles are repeated, a circular shape, a shape having a plurality of parallel lines, and the like, or may be a concentric shape.

Although the procedure of using a mask for forming the groove is described in the aforementioned embodiment, the groove may be formed by etching processing, laser processing, or the like, after printing with the abrasive layer composition on the entire surface of the substrate front face.

Figure 2:
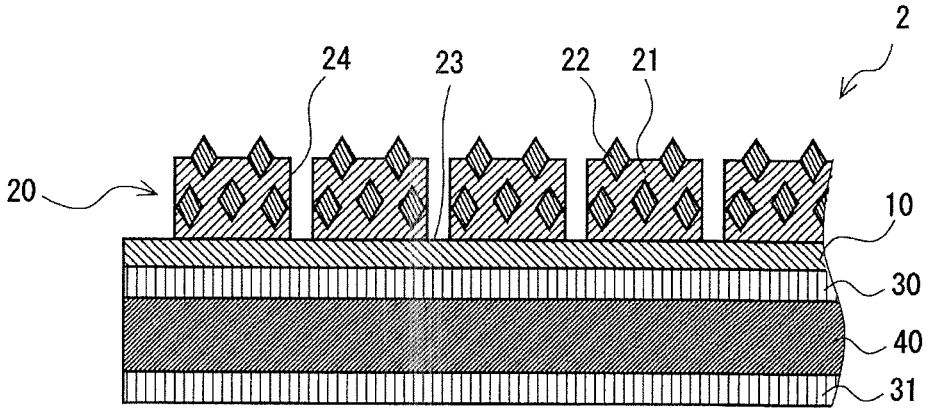
FIG. 2 is a sectional view illustrating an abrasive material according to an embodiment which is different from the embodiment shown in FIG. 1B.

Moreover, as illustrated in FIG. 2, the abrasive material 2 may include a support 40 which is laminated via an adhesion layer 30 on the back face side of a substrate 10, and a second adhesion layer 31 laminated on the back face side of the support 40. When the abrasive material 2 includes the support 40, the handling of the abrasive material 2 is facilitated.

Examples of a material for the support 40 include: thermoplastic resins such as polypropylene, polyethylene, polytetrafluoroethylene and polyvinyl chloride; and engineering plastics such as polycarbonate, polyamide and polyethylene terephthalate. When using such a material for the support 40, the support 40 has flexibility, and the abrasive material 2 follows the surface profile of a material to be cut so that a polishing face thereof and the material to be cut can be easily in contact with each other, whereby the polishing efficiency can be further improved.

The average thickness of the support 40 may be no less than 0.5 mm and no greater than 3 mm, for example. When the average thickness of the support 40 is less than the lower limit, the strength of the abrasive material 2 may be insufficient. On the other hand, when the average thickness of the support 40 is greater than the upper limit, the attachment of the support 40 to an abrasive apparatus may be difficult or the flexibility of the support 40 may be insufficient.

EXAMPLES

Hereinafter, the present invention will be explained in more detail by way of Examples and Comparative Examples, but the present invention is not limited to the following Examples.

Example 1

Diamond abrasive particles ("LS605FN" available from LANDS Superabrasives, Co.) were provided, and the average particle diameter was measured by using "Microtrac MT3300EXII" available from NIKKISO CO., LTD. The average particle diameter of the diamond abrasive particles was 7.5 μm. It should be noted that the type of diamond of the abrasive particles was treated diamond that had been subjected to 55% by mass nickel coating.

A coating liquid was obtained by: mixing a silicate salt ("No. 3 silicate soda" available from Fuji Chemical Industries Co., Ltd.), the aforementioned diamond abrasive particles, and alumina as an oxide filler (Al2O3, "LA4000" available from Pacific Rundum Co., Ltd., average particle diameter: 4 μm); and preparing the mixture so that the content of the diamond abrasive particles with respect to the abrasive layer was 30 volume % and the content of the oxide filler with respect to the abrasive layer was 40 volume %.

An aluminum plate having the average thickness of 300 μm was provided as a substrate, and an abrasive layer having grid grooves were formed by printing on the front face of the substrate using the coating liquid. It should be noted that the grooves were formed on the abrasive layer by using a mask corresponding to the grooves as a printing pattern. The protruding portions which were a plurality of regions formed by having the surface of the abrasive layer divided by the grooves were in a square shape with a side of 3 mm in a planar view and had an average thickness of 300 μm. The aforementioned protruding portions were arranged in a block pattern in which the protruding portions were provided regularly along each of mutually orthogonal X and Y directions in a planar view, and the area occupancy rate of the protruding portions with respect to the entire abrasive layer was 36%. It should be noted that the coating liquid was dried at room temperature (25° C.) for 30 minutes or longer, heated and dehydrated at 80° C. for 1 hour or longer, and then hardened at 150° C. for no less than 2 hours and no greater than 4 hours.

Furthermore, as a support for supporting the substrate and fixing it to an abrasive apparatus, a rigid vinyl chloride resin plate having an average thickness of 1 mm ("SP770" available from TAKIRON Co., LTD.) was used to laminate the back face of the substrate and the front face of the support by a tacky adhesive having an average thickness of 130 μm. A double sided tape ("#5605HGD" available from SEKISUI CHEMICAL CO., LTD.) was used as the tacky adhesive. Accordingly, the abrasive material was obtained.

Example 2

An abrasive material was obtained in a similar manner to Example 1 except that the coating liquid of Example 1 was adjusted so that the content of the diamond abrasive particles with respect to the abrasive layer was 50 volume % and the content of the oxide filler with respect to the abrasive layer was 20 volume %.

Example 3

An abrasive material was obtained in a similar manner to Example 1 except that in the formation of the abrasive layer of Example 1, the area occupancy rate of the protruding portions with respect to the entire abrasive layer was 25%.

Example 4

Diamond abrasive particles ("LS600F" available from LANDS Superabrasives, Co.) were provided, and the average particle diameter was measured by using "Microtrac MT3300EXII" available from NIKKISO CO., LTD. The average particle diameter of the diamond abrasive particles was 41 μm. It should be noted that the type of diamond of the abrasive particles was monocrystalline diamond.

A coating liquid was obtained by: mixing a silicate salt ("No. 3 silicate soda" available from Fuji Chemical Industries Co., Ltd.), the aforementioned diamond abrasive particles, and alumina as an oxide filler ($Al_2O_3$, "LA1200" available from Pacific Rundum Co., Ltd., average particle diameter: 12 μm); and adjusting the mixture so that the content of the diamond abrasive particles with respect to the abrasive layer was 5 volume % and the content of the oxide filler with respect to the abrasive layer was 71 volume %.

An abrasive material was obtained in a similar manner to Example 1 except that the aforementioned coating liquid was used.

Examples 5 to 14

Examples 5 to 14 were obtained by changing: the type of diamond, the average particle diameter and the content of diamond abrasive particles; the groove shape of the abrasive layer; and the type, the average particle diameter and the content of the oxide filler of Example 4, as shown in Table 1. It should be noted that, regarding the type of diamond abrasive particles, "LS600X" available from LANDS Superabrasives, Co. was used as polycrystalline diamond abrasive particles, and the diamond abrasive particles that had been subjected to 55% by mass nickel coating was used as treated diamond ("LS605FN" available from LANDS Superabrasives, Co.). Furthermore, regarding the type of the oxide filler: "LA4000" available from Pacific Rundum Co., Ltd. was used as alumina in Examples 11, 13 and 14; "ASFP-20" available from Denki Kagaku Kogyo Kabushiki Kaisha (Denka Company Limited.) was used as alumina in Example 12; "BR-12QZ" available from DAIICHI KIGENSO KAGAKU KOGYO CO., LTD. was used as zirconia ($ZrO_2$); "Sylysia 470" available from FUJI SILYSIA CHEMICAL LTD. was used as silica ($SiO_2$) in Example 7; "AEROSIL OX50" (registered trademark) available from Nippon Aerosil Co., Ltd. was used as silica ($SiO_2$) in Examples 11 and 12; "SHOROX A-10" available from SHOWA DENKO K.K. was used as cerium oxide ($CeO_2$); and "STARMAG L" available from Konoshima Chemical Co., Ltd. was used as magnesium oxide (MgO).

Comparative Example 1

A coating liquid was obtained by: adding an epoxy resin ("JER828" available from Mitsubishi Chemical Corporation), diamond abrasive particles, (monocrystalline, "LS600F" available from LANDS Superabrasives, Co., average particle diameter: 7.5 μm), and a hardening agent ("YH306" available from Mitsubishi Chemical Corporation and "Curezol 1B2MZ" available from SHIKOKU CHEMICALS CORPORATION) to a diluent (isophorone) followed by mixing; and adjusting the mixture so that the content of the diamond abrasive particles with respect to the abrasive layer was 47 volume %. It should be noted that an oxide filler was not added to the coating liquid of Comparative Example 1.

An abrasive material of Comparative Example 1 was obtained in a similar manner to Example 1 except that the aforementioned coating liquid was used.

Comparative Example 2

A coating liquid was obtained by: mixing a silicate salt ("No. 3 silicate soda" available from Fuji Chemical Industries Co., Ltd.) and alumina as an oxide filler (Al2O3, "LA800" available from Pacific Rundum Co., Ltd., the average particle diameter: 30 μm); and adjusting the mixture so that the content of the oxide filler with respect to the abrasive layer was 73 volume %. It should be noted that diamond abrasive particles were not added to the coating liquid of Comparative Example 2.

An abrasive material of Comparative Example 2 was obtained in a similar manner to Example 1 except that the aforementioned coating liquid was used.

Comparative Example 3

A coating liquid was obtained by: adding epoxy resin ("JER828" available from Mitsubishi Chemical Corporation), diamond abrasive particles, (monocrystalline, "LS600F" available from LANDS Superabrasives, Co., average particle diameter: 35 μm), and a hardening agent ("YH306" available from Mitsubishi Chemical Corporation and "Curezol 1B2MZ" available from SHIKOKU CHEMICALS CORPORATION) to a diluent (isophorone) followed by mixing; and adjusting the mixture so that the content of the diamond abrasive particles with respect to the abrasive layer was 45 volume %. It should be noted that an oxide filler was not added to the coating liquid of Comparative Example 3.

An abrasive layer was formed by printing similarly to the printing of Example 1 on a front face of the substrate similarly to that of Example 1 using the aforementioned coating liquid. It should be noted that the coating liquid was dried at 120° C. for 3 minutes or longer and then hardened at 120° C. for no less than 16 hours and no greater than 20 hours.

An abrasive material of Comparative Example 3 was obtained by further laminating the back face of the substrate and the support in a similar manner to Example 1.

Comparative Example 4

An abrasive material of Comparative Example 4 was obtained in a similar manner to Comparative Example 3 except that the diamond abrasive particles of the coating liquid of Comparative Example 3 had an average particle diameter of 50 μm.

Comparative Example 5

A coating liquid was obtained by: adding an epoxy resin ("JER828" available from Mitsubishi Chemical Corporation), diamond abrasive particles, (monocrystalline, "LS600F" available from LANDS Superabrasives, Co., average particle diameter: 35 μm), alumina as an oxide filler ($Al_2O_3$, "LA1200" available from Pacific Rundum Co., Ltd., the average particle diameter: 12 μm), and a hardening agent ("YH306" available from Mitsubishi Chemical Corporation and "Curezol 1B2MZ" available from SHIKOKU CHEMICALS CORPORATION) to a diluent (isophorone) followed by mixing; and adjusting the mixture so that the content of the diamond abrasive particles with respect to the abrasive layer was 20 volume % and the content of the oxide filler with respect to the abrasive layer was 30 volume %.

An abrasive material of Comparative Example 5 was obtained in a similar manner to Comparative Example 3 except that the aforementioned coating liquid was used.

Polishing Conditions

A glass substrate was polished by using the abrasive materials obtained in Examples 1 to 3 and Comparative Example 1. For the glass substrate, three pieces of soda-lime glass each having a diameter of 6.25 cm and a specific gravity of 2.4 (available from Hiraoka Special Glass Mfg. Co., Ltd.) were used. For the polishing, a commercially available double side polisher ("EJD-5B-3W" available from Engis Japan Corporation) was used. A carrier of the double side polisher is an epoxy glass having a thickness of 0.4 mm. The polishing was performed for 15 minutes under the conditions involving the polishing pressure of 150 g/cm$^2$, the number of rotations of the upper surface plate of 60 rpm, the number of rotations of the lower surface plate of 90 rpm, and the number of rotations of the SUN gear of 10 rpm. During this procedure, "TOOLMATE GR-20" available from MORESCO Corporation was supplied at a rate of 120 cc per minute as a coolant.

Furthermore, a sapphire substrate was polished by using the abrasive materials obtained in Examples 4 to 14 and Comparative Examples 2 to 5. For the sapphire substrate, three pieces of C-plane sapphire each having a diameter of 2 inches and a specific gravity of 3.97 (as-lapped, available from Doujinsangyo CO., Ltd.) were used. For the polishing, a commercially available double side polisher ("EJD-5B-3W" available from Engis Japan Corporation) was used. A carrier of the double side polisher is an epoxy glass having a thickness of no less than 0.2 mm and no greater than 0.4 mm. The polishing was performed under the conditions involving the polishing pressure of 200 g/cm$^2$, the number of rotations of the upper surface plate of 40 rpm, the number of rotations of the lower surface plate was 60 rpm, and the number of rotations of the SUN gear of 20 rpm. During this procedure, "Daphne Cut GS50K" available from Idemitsu Kosan CO., Ltd. was supplied at a rate of 5 cc to 30 cc per minute as a coolant.

Evaluation Procedures

The maximum peak height (Rp) on the front faces of the abrasive layers of the abrasive materials of Examples 1 to 14 and Comparative Examples 1 to 5, and the polishing speed and the surface roughness (Ra) of the materials to be cut after being polished for the substrates (the glass substrate and the sapphire substrate) polished by using the abrasive materials were determined. The results are shown in Table 1.

Maximum Peak Height

By using a surface roughness tester ("SV-C4100" available from Mitutoyo Corporation), the measurement of the maximum peak height was performed at arbitrary three locations on the front face of the abrasive layer according to the method defined in JIS-B-0601:2001, with the settings of: feed rate of 0.2 mm/sec.; cut-off of 0.25 mm; and measuring length of 1.25 mm, and the average value of the resultant measured values was calculated.

Polishing Speed

The polishing speed was calculated by dividing a weight change (g) of the substrate after being polished, by the surface area (cm$^2$) of the substrate, the specific gravity (g/cm$^3$) of the substrate, and a polishing time period (minute).

Surface Roughness

The measurement of surface roughness in Examples 1 to 10 was performed at arbitrary four locations on the front face and the back face, respectively, by using a contact surface roughness tester ("S-3000" available from Mitutoyo Corporation), and the average value of the eight locations in total was calculated. Meanwhile, since the surface roughness in Examples 11 to 14 was less than that of Examples 1 to 10, the measurement of surface roughness in Examples 11 to 14 was performed at arbitrary four locations on the front face and the back face, respectively, by using an optical profiler "Wyko NT1100" available from Burker Corporation, and the average value of the eight locations in total was calculated. Regarding Comparative Examples 1 to 5, since surface roughness, which should have appeared naturally on a material to be cut, was not exhibited due to insufficient polishing force, the measurement was not performed.

TABLE 1

| | | Abrasive particles | | | Groove | | |
|---|---|---|---|---|---|---|---|
| | Binder Type | Type of Diamond | Average particle diameter μμm | Content volume % | Shape | Area occupancy Rate % | Oxide filler Type |
| Example 1 | inorganic | treated | 7.5 | 30 | grid | 36 | $Al_2O_3$ |
| Example 2 | inorganic | treated | 7.5 | 50 | grid | 36 | $Al_2O_3$ |
| Example 3 | inorganic | treated | 7.5 | 30 | grid | 25 | $Al_2O_3$ |
| Example 4 | inorganic | monocrystalline | 41 | 5 | grid | 36 | $Al_2O_3$ |
| Example 5 | inorganic | treated | 35 | 5 | grid | 36 | $Al_2O_3$ |
| Example 6 | inorganic | treated | 35 | 5 | grid | 36 | $ZrO_2$ |
| Example 7 | inorganic | treated | 35 | 5 | grid | 36 | $Al_2O_3/SiO_2$ |
| Example 8 | inorganic | treated | 35 | 5 | grid | 36 | $Al_2O_3/CeO_2$ |
| Example 9 | inorganic | treated | 35 | 5 | grid | 36 | $Al_2O_3/MgO$ |
| Example 10 | inorganic | treated | 35 | 48 | grid | 36 | $Al_2O_3$ |
| Example 11 | inorganic | polycrystalline | 8 | 10 | concentric | 36 | $Al_2O_3/SiO_2$ |
| Example 12 | inorganic | polycrystalline | 3 | 10 | concentric | 36 | $Al_2O_3/SiO_2$ |
| Example 13 | inorganic | polycrystalline | 6 | 30 | grid | 36 | $Al_2O_3$ |
| Example 14 | inorganic | monocrystalline | 6 | 30 | grid | 36 | $Al_2O_3$ |
| Comparative Example 1 | epoxy | monocrystalline | 7.5 | 47 | grid | 36 | — |
| Comparative Example 2 | inorganic | none | — | — | grid | 36 | $Al_2O_3$ |
| Comparative Example 3 | epoxy | monocrystalline | 35 | 45 | grid | 36 | — |
| Comparative Example 4 | epoxy | monocrystalline | 50 | 45 | grid | 36 | — |
| Comparative Example 5 | epoxy | monocrystalline | 35 | 20 | grid | 36 | $Al_2O_3$ |

| | Oxide filler | | Abrasive layer Maximum | Material to be cut | | |
|---|---|---|---|---|---|---|
| | Average particles diameter μμm | Content volume % | peak height (Rp) μm | Material | Polishing speed μm/minute | Surface roughness (Ra) μm |
| Example 1 | 4 | 40 | 4.8 | glass | 9.37 | 0.24 |
| Example 2 | 4 | 20 | 8.4 | glass | 10.31 | 0.21 |
| Example 3 | 4 | 40 | 4.8 | glass | 8.43 | 0.2 |
| Example 4 | 12 | 71 | 4.7 | sapphire | 11.2 | 0.42 |
| Example 5 | 12 | 71 | 5.6 | sapphire | 7.5 | 0.3 |
| Example 6 | 11 | 71 | 6.5 | sapphire | 7.4 | 0.29 |
| Example 7 | 12/14 | 37/13 | 6.3 | sapphire | 7.2 | 0.26 |
| Example 8 | 12/1.2 | May-55 | 4.1 | sapphire | 7.7 | 0.3 |
| Example 9 | 12/3.5 | Sep-58 | 3.5 | sapphire | 8.5 | 0.32 |
| Example 10 | 12 | 28 | 11.2 | sapphire | 4.8 | 0.29 |
| Example 11 | 4/0.04 | 22/16 | 4.7 | sapphire | 0.29 | 0.053 |
| Example 12 | 0.3/0.04 | Sep-37 | 3.1 | sapphire | 0.35 | 0.029 |
| Example 13 | 4 | 40 | 3.8 | sapphire | 1.0 | 0.06 |
| Example 14 | 4 | 40 | 3 | sapphire | 0.5 | 0.064 |
| Comparative Example 1 | — | — | 2.1 | glass | 1.44 | not determined |
| Comparative Example 2 | 30 | 73 | 9.3 | sapphire | 0.03 | not determined |
| Comparative Example 3 | — | — | 1.8 | sapphire | 0.65 | not determined |
| Comparative Example 4 | — | — | 2.1 | sapphire | 0.6 | not determined |
| Comparative Example 5 | 12 | 30 | 1.5 | sapphire | 0.4 | not determined |

With reference to Table 1, the polishing speed of the abrasive materials in Examples 1 to 3 was greater than that of the abrasive material in Comparative Example 1 in the polishing of the glass substrate. Furthermore, the polishing speed of the abrasive materials in Examples 4 to 10 was greater than that of the abrasive materials in Comparative Examples 2 to 5 in the polishing of the sapphire substrate. In these regards, it is considered that the polishing speed in Comparative Example 2 was low resulting from the absence of the abrasive particles in the abrasive layer, and attaining a high polishing speed was impossible in Comparative Examples 1 and 3 to 5 since the abrasive particles were likely to be separated resulting from the principal component of the binder not being an inorganic substance, and since the maximum peak height (Rp) was low.

Furthermore, it is revealed that for the abrasive materials in Examples 11 to 14 having a small average particle diameter of the abrasive particles, the surface roughness of the material to be cut after being polished was lower, and thus the accuracy of polishing was higher, as compared with the abrasive materials in Comparative Examples 2 to 5.

As can be understood from above, it is concluded that when the abrasive layer includes the binder containing an inorganic substance as a principal component and the abrasive particles dispersed in this binder, and the maximum peak height (Rp) on the front face of the abrasive layer falls within a predetermined range, the abrasive material provides a high polishing efficiency and a high polishing accuracy.

INDUSTRIAL APPLICABILITY

The abrasive material according to the aspect of the present invention enables a processing efficiency and a finished planarity of a substrate material to be simultaneously improved, and polishing costs to be reduced. Therefore, the abrasive material according to the aspect of the present invention can be preferably used for polishing a glass substrate used for electronic devices, etc., and a difficult-to-process substrate composed of sapphire, silicon carbide or the like.

What is claimed is:

1. An abrasive material comprising a substrate and an abrasive layer laminated on a front face side of the substrate, wherein the abrasive layer comprises a binder comprising an inorganic substance as a principal component, and abrasive particles dispersed in the binder, a front face of the abrasive layer comprises a plurality of regions provided through dividing by grooves, a part of the abrasive particles projects from a surface of the binder, and a maximum peak height (Rp) on the front face of the abrasive layer is no less than 2.5 μm and no greater than 70 μm.

2. The abrasive material according to claim 1, wherein the plurality of regions are provided such that at least two thereof are disposed along each of mutually orthogonal X and Y directions in a planar view.

3. The abrasive material according to claim 1, wherein the binder comprises an oxide filler comprising an oxide as a principal component, an average particle diameter of the oxide filler is smaller than an average particle diameter of the abrasive particles, and a ratio of the average particle diameter of the oxide filler to the average particle diameter of the abrasive particles is no less than 0.1 and no greater than 0.8.

4. The abrasive material according to claim 1, wherein the inorganic substance is a silicate salt.

5. The abrasive material according to claim 1, wherein the abrasive particles are diamond.

6. The abrasive material according to claim 1, wherein the abrasive layer is formed by a printing process.

7. A production method of an abrasive material comprising a substrate and an abrasive layer laminated on a front face side of the substrate, a front face of the abrasive layer comprising a plurality of regions provided through dividing by grooves, the method comprising forming the abrasive layer by printing with an abrasive layer composition, in which a maximum peak height (Rp) on the front face of the abrasive layer is controlled to be no less than 2.5 μm and no greater than 70 μm, wherein the abrasive layer composition comprises a binder component comprising an inorganic substance as a principal component, and abrasive particles, and the abrasive layer composition is subjected to a dilution before the printing to allow a part of the abrasive particles to project from a surface of the binder.

8. The abrasive material according to claim 1, wherein a front face of each of the plurality of regions comprises fine unevenness principally due to the part of the abrasive particles projecting from the surface of the binder.

* * * * *